US008870242B2

(12) United States Patent
Quijano

(10) Patent No.: US 8,870,242 B2
(45) Date of Patent: Oct. 28, 2014

(54) HEART SHAPED LOCK WITH SLIDING BREAKAWAY FEATURE

(75) Inventor: Jonathan Joseph Quijano, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 191 days.

(21) Appl. No.: 13/435,012

(22) Filed: Mar. 30, 2012

(65) Prior Publication Data

US 2013/0257064 A1 Oct. 3, 2013

(51) Int. Cl.
*E05C 1/12* (2006.01)

(52) U.S. Cl.
USPC ..... 292/169; 292/DIG. 4

(58) Field of Classification Search
USPC ..... 292/169, DIG. 4
See application file for complete search history.

(56) References Cited

U.S. PATENT DOCUMENTS

| | | | | |
|---|---|---|---|---|
| 4,331,355 | A * | 5/1982 | Okuno | 292/251.5 |
| 4,616,861 | A * | 10/1986 | Kurosaki | 292/6 |
| 4,820,093 | A * | 4/1989 | Hirakui et al. | 410/107 |
| 5,539,169 | A | 7/1996 | Sekita | |
| 6,207,915 | B1 | 3/2001 | Kimura | |
| 7,017,956 | B2 | 3/2006 | Kogami | |
| 2007/0024065 | A1 * | 2/2007 | Hisatomi et al. | 292/304 |

* cited by examiner

*Primary Examiner* — Mark Williams
(74) *Attorney, Agent, or Firm* — Gifford, Krass, Sprinkle, Anderson & Citkowski, P.C.

(57) ABSTRACT

A push-push heart cam lock assembly for use in connection with a slidable tray within a vehicle. The push-push heart cam includes a breakaway feature to prevent breakage of the pin if a user pulls the assembly rather than pushes the assembly when attempting to close the assembly. The assembly includes a base, a track formed in the base, and a pin slidable within the track which is formed on the base. The assembly further includes a heart shaped cam having a fixed piece and a movable piece wherein the fixed piece and the movable piece of the heart shaped cam are mounted within the track of the base. In the event that the user pulls the slidable mechanism, the pin moves between the fixed piece and the movable piece of the heart shaped cam.

10 Claims, 5 Drawing Sheets

HEART SHAPED LOCK WITH SLIDING BREAKAWAY FEATURE

FIELD OF THE INVENTION

This invention relates generally to push-push locking assemblies. More particularly, this invention relates to a push-push assembly having a heart cam with a breakaway feature.

BACKGROUND OF THE INVENTION

It is commonly known in the art to provide for push-push closing and locking mechanisms within a vehicle. These mechanisms are opened by pushing on the front of a planar structure and allowing the tray, cover, or other apparatus to move to an open position. The apparatus is pushed a second time to achieve a closed position. Such push-push configurations require the use of a heart shaped cam, track, and pin to open and close the assembly. Typical assemblies include a molded track having a one piece heart shaped cam allowing a pin to move through the track and around the heart shaped cam.

Push-push assemblies do not provide for accidental or intentional pulling of the sliding mechanism. By way of example, a push-push mechanism for a tray wherein the tray includes a slightly turned up handle may entice a user to pull the handle rather than push the handle to release the push-push lock on the heart cam. In the event that a user pulls the assembly (rather than push the assembly), the pin, cam, and/or track may be broken by the user. In this event, the pin may be drug over the top surface of the heart cam or alternatively the pin will be broken. Accordingly, there exists a need in the art to provide a push-push mechanism which prevents breakage of the system when a mechanism is pulled by the user.

SUMMARY OF THE INVENTION

The present invention relates to a push-push heart cam lock assembly for use in connection with a slidable tray within a vehicle. The push-push heart cam includes a breakaway feature to prevent breakage of the pin if a user pulls the assembly rather than pushes the assembly when attempting to close the assembly. The assembly includes a base, a track formed in the base, and a pin slidable within the track which is formed on the base. The assembly further includes a heart shaped cam having a fixed piece and a movable piece wherein the fixed piece and the movable piece of the heart shaped cam are mounted within the track of the base. The assembly further includes the fixed piece and the movable piece are positioned adjacent one another allowing the pin to slide within the track to a locked resting position. In the event that the user pulls the slidable mechanism, the pin moves between the fixed piece and the movable piece of the heart shaped cam. The movable piece of the heart shaped cam is mounted to a biasing member to return the movable piece to a resting position. After the pin moves between the fixed piece and the movable piece of the heart shaped cam, the pin continues to slide down the track to achieve a closed position. The user may then push the sliding mechanism to an open, locked position without the worry of any breakage of the pin.

DETAILED DESCRIPTION OF THE DRAWINGS

The present assembly is for use with a slidable mechanism having a breakaway feature to prevent breakage of a pin in a heart shaped cam assembly. The heart shaped cam is comprised of two pieces: a fixed piece and a movable piece. Both pieces of the heart shaped cam are mounted within a slidable track molded into a housing. The movable piece of the heart shaped cam is attached to a biasing member. As the pin moves up the track and into the resting portion at the top of the heart shaped cam, and the user decides to pull, rather than push, the slidable assembly, the pin travels between the fixed piece and the movable piece moving the fixed piece and the movable piece apart to accommodate the pin allowing the pin to continue movement down the track.

Figure 1:
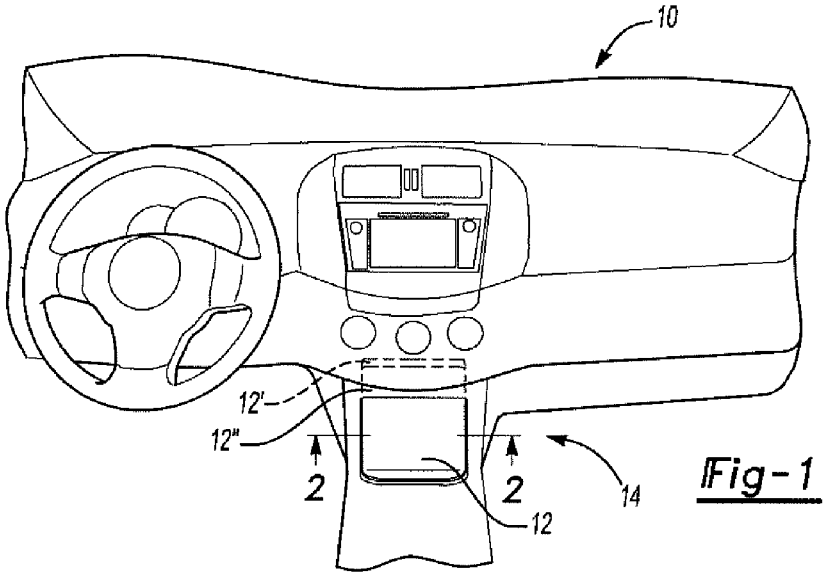
FIG. 1 illustrates a perspective view of the environment of the sliding tray.

FIG. 1 illustrates an environmental view of a slidable tray member 12. The slidable tray moves to an extended position 12' and finally to a locked, resting position 12". The slidable tray is mounted within the console 14 of the vehicle 10.

Figure 2:
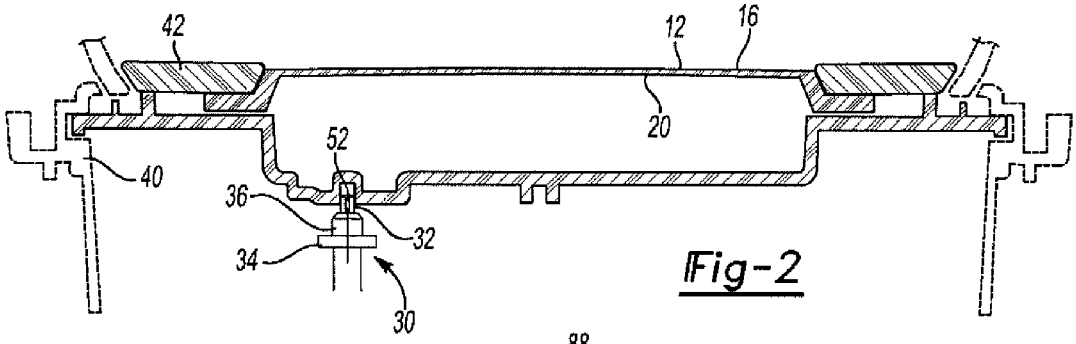
FIG. 2 illustrates a cross-sectional view of the sliding tray along the section 2-2 as shown in FIG. 1.

FIG. 2 illustrates a cross-sectional view along the line 2-2 of FIG. 1. A slidable tray 12 is shown having an upper surface 16. The slidable tray 12 is held in place by support members 40, 42. The slidable tray 12 further includes an underside surface 20. The underside surface 20 includes the molded track assembly 32. A pin structure 30 is provided having support structure 34, 36 and a pin 52 slidable within the track assembly 32.

Figure 4:
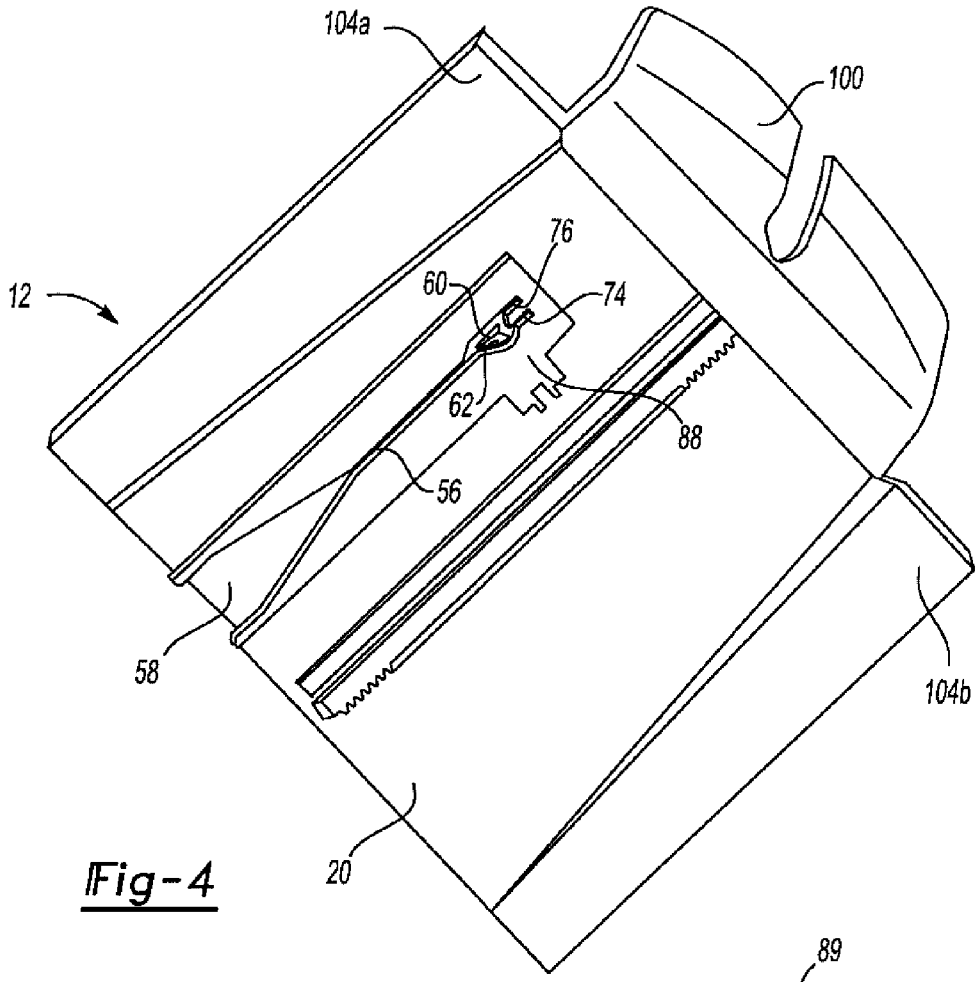
FIG. 4 illustrates an underside view of the slidable tray.

FIG. 4 illustrates the underside of the slidable tray 12. The slidable tray 12 includes the underside surface 20 having a track 56 molded thereon. The tray 12 and track 56 include a wide track portion 58 ensuring the pin 52 will enter the track 56. The track 56 further includes a first upper track portion 74 and a second upper track portion 76. The track further includes a fixed heart cam piece 60 and a movable heart cam piece 62. Housing 88 for the movable piece mechanism is also provided. The tray 12 further includes side walls **104*a*, 104*b* and a handle 100. The handle 100** is intended to be pushed, rather than pulled.

Figure 5:
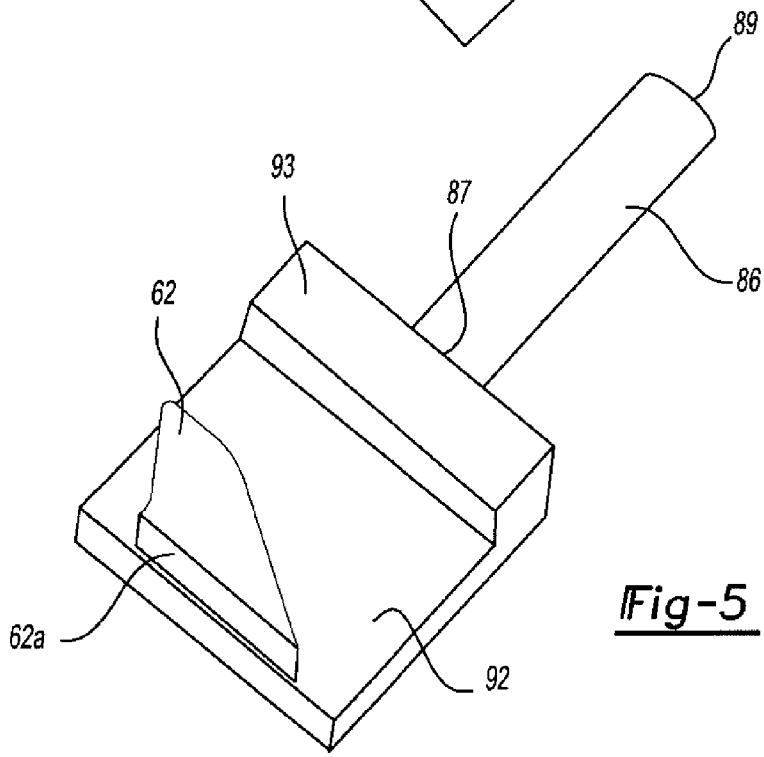
FIG. 5 illustrates a perspective view of the movable piece of the heart shaped cam.
Figure 6:
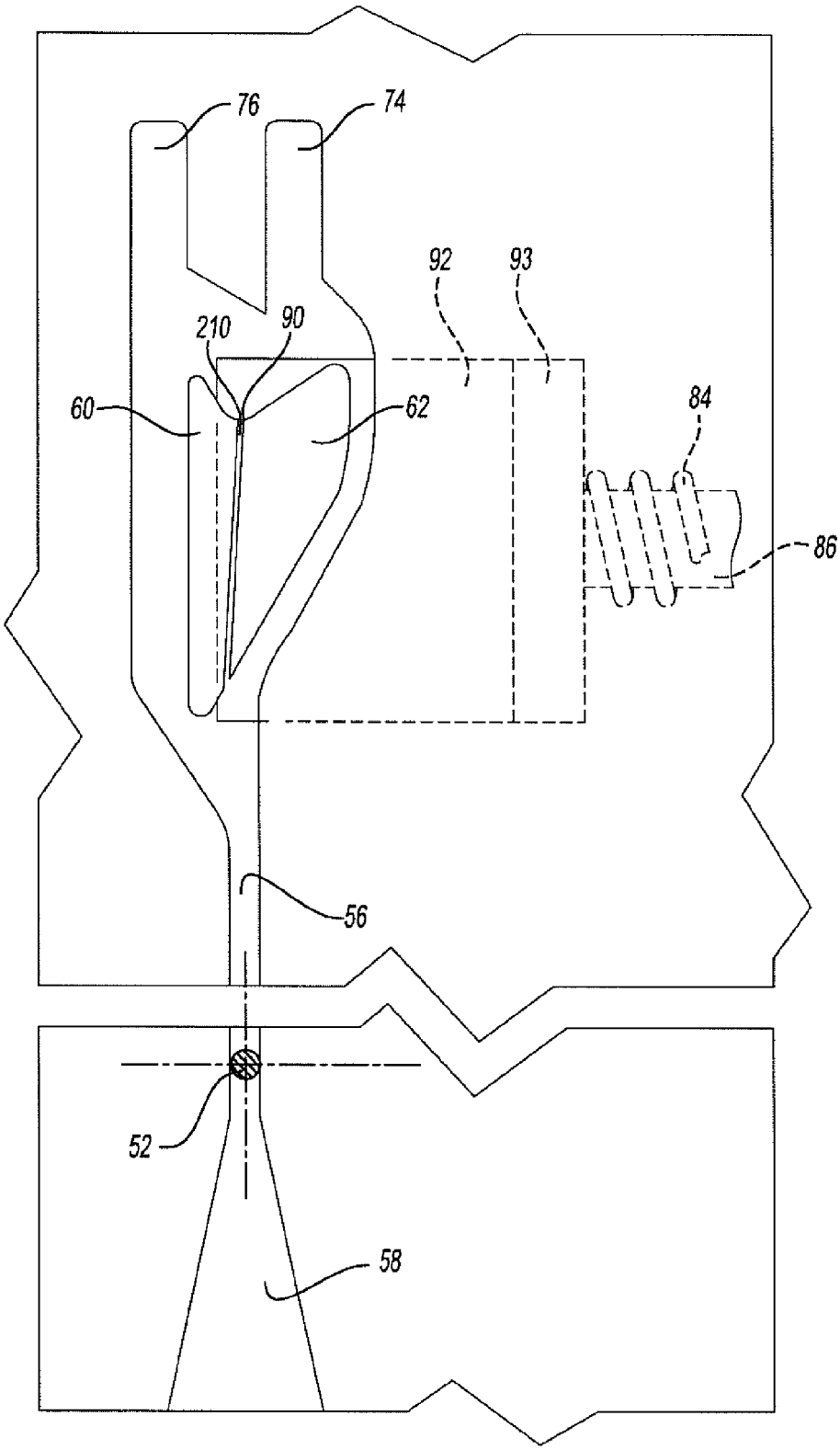
FIG. 6 illustrates a top view having phantom views of the heart shaped cam having a breakaway feature.
Figure 7:
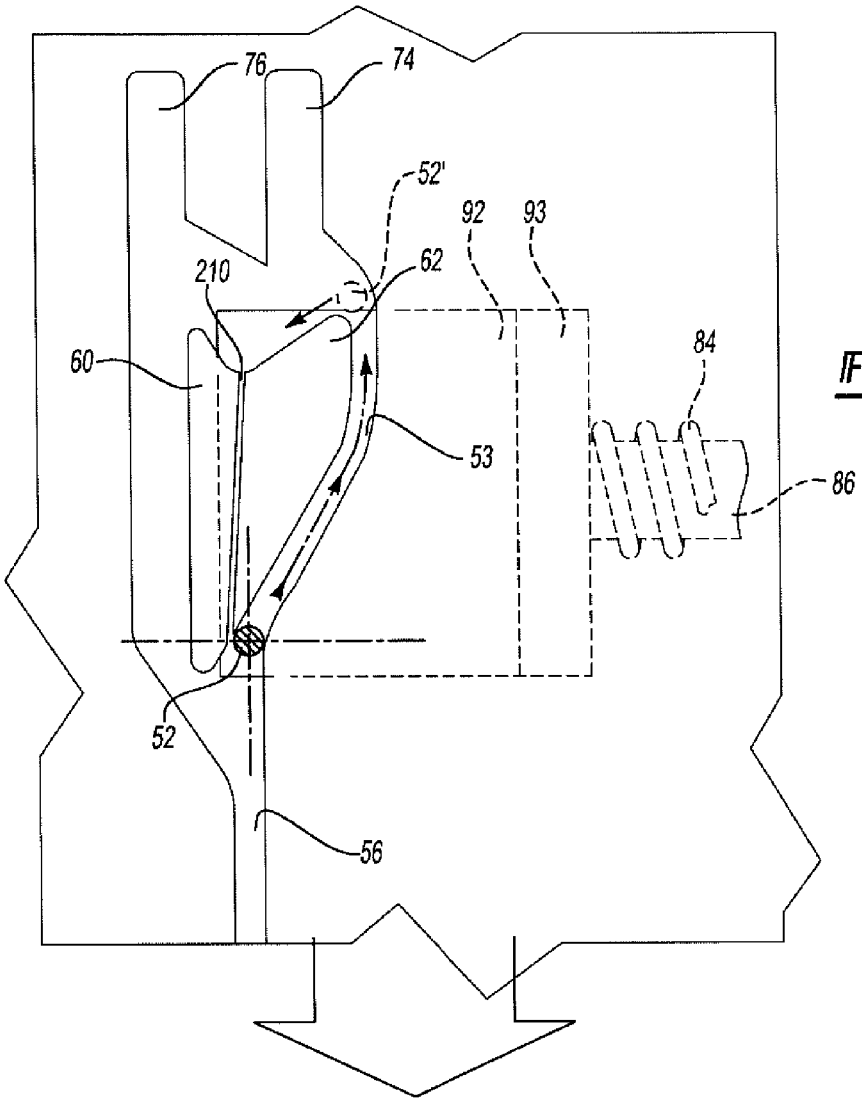
FIG. 7 illustrates the movement of the pin through the track.
Figure 8:
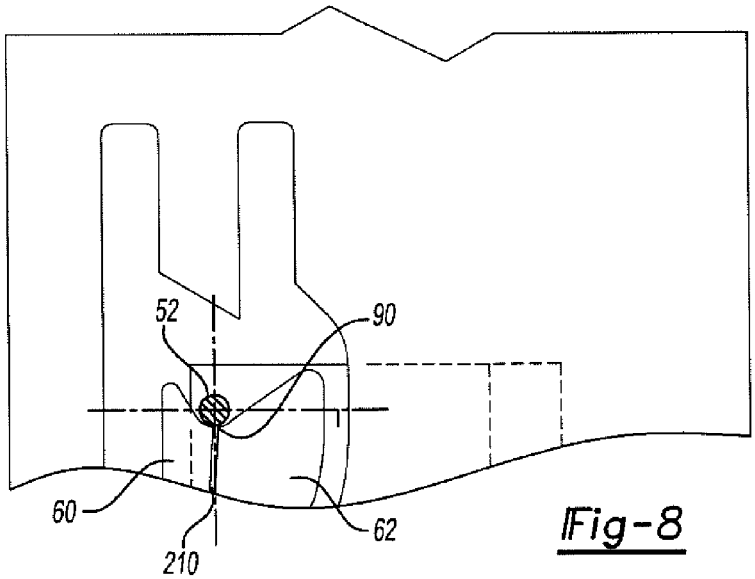
FIG. 8 illustrates the open, resting, locked position of the pin at the top of the heart shaped cam.

FIG. 5 illustrates the movable piece 62 of the heart cam assembly. The movable piece 62 is attached to a base member 92 having an upper portion 93. The base 92 is attached to a cylindrical member 86 having a first end 87 and a second end 89. The base 92 attaches to the cylindrical member 86 at the first end 87. The movable piece 62 includes a planar inner surface **62*a***.

FIGS. 3 and 6-10 illustrate the movement of the pin 52 through the track 56. The movable piece 62 is attached to a base portion 92. The base portion 92 is mounted within a housing 88. The housing 88 includes a biasing member 84 and a cylindrical member 86. The biasing member 84 and the cylindrical member 86 are attached to the base member 92 which is in turn attached to the movable piece 62 of the heart cam assembly. When the pin is in a locked position at the top of the heart cam shown at 90, and the user pulls the slidable tray to a closed position, the pin forces the movable piece 62 away from the fixed piece 60 and the biasing member is engaged. In the present embodiment, the biasing member is a linear spring. The linear spring or biasing member 84 is compressed allowing the movable piece 62 to move out of the way allowing sufficient room for the pin 52 to travel between the fixed piece 60 and the movable piece 62.

Figure 3:
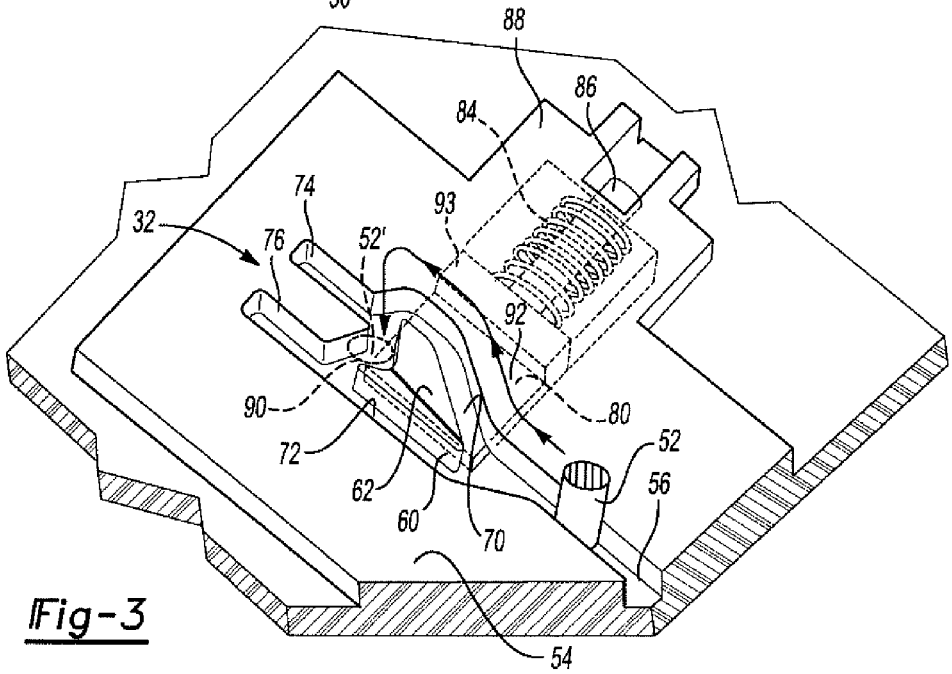
FIG. 3 illustrates a perspective view of the heart shaped cam having the breakaway feature.

FIG. 3 illustrates the pin 52 moving through the track 56 on the housing 54. As shown by directional arrows 80, the pin 52 moves up through the track to the first upper track portion 74. Once the pin 52 reaches the upper track portion 74, the user hears a click and releases the slidable tray. The pin then moves to the resting, locked position at the top of the heart cam 90. The pin rests in an open position when the pin 52 is located at the top of the heart cam 90.

In normal circumstances, the pin 56 continues through the track after the user pushes the slidable tray. In normal circumstances, the pin 52 moves up into the second upper track portion 76 as shown by directional arrows 230, 260 in FIG. 10. The pin 52 moves up into the upper track portion 76 and down continuing along the remainder of the track 56 to a closed position.

When the pin is in the resting position, it is located at the upper portion of the heart shaped cam pieces 60, 62. The fixed piece 60 and the movable piece 62 of the heart cam assembly are positioned adjacent one another. As the pin is forced between the fixed piece 60 and the movable piece 62, a space between the fixed piece 60 and the movable piece 62 is formed. The space is illustrated at reference numeral 210.

Figure 9:
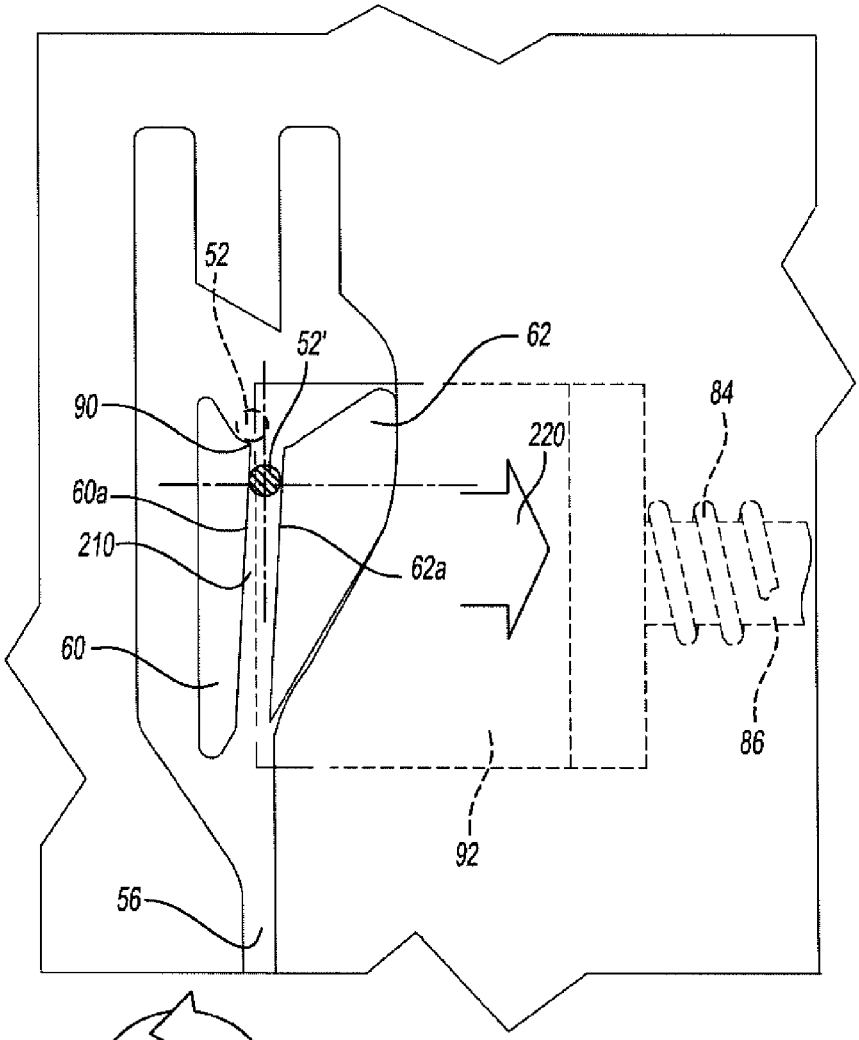
FIG. 9 illustrates movement of the breakaway feature and the pin sliding between the fixed piece and the movable piece of the heart shaped cam.
Figure 10:
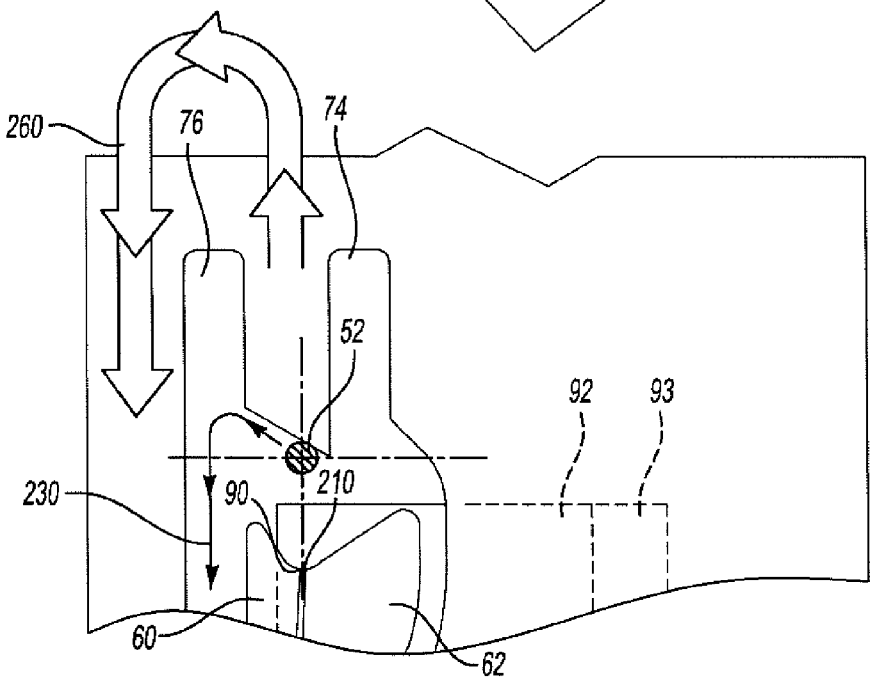
FIG. 10 illustrates movement of the pin after the slidable tray is pushed moving towards a closed position.

FIG. 9 illustrates movement of the pin 52 within the space 210 created between the fixed piece 60 and the movable piece 62. The fixed piece 60 includes an inner surface 60*a*. The movable piece 62 includes an inner surface 62*a*. In a resting, locked position when the pin 52 is at the position 90, the space 210 is either extremely minimal or nonexistent. The surfaces 60*a*, 60*b* are either touching or extremely close. As the pin 52 creates the space 210 between the surfaces 60*a*, 60*b*, the space 210 is made large enough to accommodate the pin shown by reference numeral 52'. As the pin 52' pushes the movable piece 62, the biasing member 84 is compressed. The pin 52' moves 220 the movable piece 62 along with the base 92 away from the fixed piece 60. The pin 52' continues down through the track 56 to a resting portion and out of the track past the wide portion 58 of the track. This movement through the space 210 between the surfaces 60*a*, 62*a* of the fixed piece 60 and the movable piece 62 prevents any breakage of the pin or other assembly part of the heart cam assembly.

The invention is not restricted to the illustrative examples and embodiments described above. The embodiments are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the appended claims.

The invention claimed is:

1. A push-push heart cam lock assembly for a slidable element within a vehicle, the lock including a pin mounted thereon, the lock assembly comprising:

a base;

a track formed on the base, the pin slidable within the track formed on the base;

a heart shaped cam, the heart shaped cam having a fixed piece and a movable piece, the fixed piece and the movable piece of the heart shaped cam mounted within the track on the base;

the movable piece having a first position defined when the fixed piece and the movable piece of the heart shaped cam are positioned adjacent one another such that the fixed piece and the movable piece contact or nearly contact each other, the movable piece having a second position where the fixed piece and the movable piece are forced into a spaced apart configuration by the pin to form a subtrack for the pin upon pulling of the slideable element, the pin operable to slide between the fixed piece and the movable piece along the subtrack of the heart shaped cam thereby preventing breakage of the pin or the assembly.

2. The assembly of claim 1 wherein the movable piece of the heart shaped cam is connected to a biasing member.

3. The assembly of claim 2 wherein the biasing member is mounted within the base.

4. The assembly of claim 2 wherein the biasing member is a linear spring.

5. The assembly of claim 1 wherein the track on the base includes an elongated track portion.

6. The assembly of claim 1 wherein the track includes at least two semi-elongated track portions operable to allow the pin to temporarily slide within each of the two semi-elongated track portions.

7. The assembly of claim 1 wherein the fixed piece and the movable piece of the heart shaped cam are spaced apart a predetermined distance when the movable piece is in the first position.

8. The assembly of claim 7 wherein the predetermined distance is less than the width of the pin.

9. The assembly of claim 2 wherein the biasing member has sufficient force to prevent unintentional passing of the pin between the fixed piece and the movable piece.

10. The assembly of claim 1 wherein the fixed piece and the movable piece resting adjacent one another are touching when the movable piece is in the first position.

* * * * *